US009463635B2

(12) United States Patent
Enomoto et al.

(10) Patent No.: US 9,463,635 B2
(45) **Date of Patent: *Oct. 11, 2016**

(54) LIQUID EJECTING APPARATUS

(71) Applicant: Seiko Epson Corporation, Tokyo (JP)

(72) Inventors: Katsumi Enomoto, Matsumoto (JP); Toshio Arimura, Shiojiri (JP); Yoshihiro Kobayashi, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 129 days.

This patent is subject to a terminal disclaimer.

(21) Appl. No.: 14/313,797

(22) Filed: Jun. 24, 2014

(65) Prior Publication Data

US 2014/0320571 A1 Oct. 30, 2014

Related U.S. Application Data

(63) Continuation of application No. 13/038,301, filed on Mar. 1, 2011, now Pat. No. 8,794,747.

(30) Foreign Application Priority Data

Mar. 1, 2010 (JP) ..... 2010-043858

(51) Int. Cl.
*B41J 2/18* (2006.01)
*B41J 2/175* (2006.01)

(52) U.S. Cl.
CPC *B41J 2/18* (2013.01); *B41J 2/175* (2013.01); *B41J 2/17596* (2013.01)

(58) Field of Classification Search
CPC ..... B41J 2/175; B41J 2/17513
USPC ..... 347/84, 85, 89, 6, 7
See application file for complete search history.

(56) References Cited

U.S. PATENT DOCUMENTS

| | | | | |
|---|---|---|---|---|
| 4,737,801 | A | 4/1988 | Ichihashi et al. | |
| 5,561,448 | A | 10/1996 | Kaneko et al. | |
| 5,565,900 | A | 10/1996 | Cowger et al. | |
| 5,751,300 | A * | 5/1998 | Cowger | B41J 2/17509 347/37 |
| 6,082,851 | A | 7/2000 | Shihoh et al. | |
| 6,406,137 | B1 | 6/2002 | Okazaki et al. | |
| 7,828,425 | B2 | 11/2010 | Kang et al. | |
| 8,100,517 | B2 | 1/2012 | Karppinen et al. | |
| 8,128,212 | B2 | 3/2012 | Katada et al. | |
| 8,171,876 | B2 | 5/2012 | Namekawa et al. | |

(Continued)

FOREIGN PATENT DOCUMENTS

| | | | |
|---|---|---|---|
| CN | 101152798 | A | 4/2008 |
| JP | 3-208665 | A | 9/1991 |

(Continued)

*Primary Examiner* — Matthew Luu
*Assistant Examiner* — Patrick King
(74) *Attorney, Agent, or Firm* — Kilpatrick Townsend & Stockton LLP

(57) ABSTRACT

A liquid storage unit for collecting a liquid supplied to an ejecting head is provided. The liquid is supplied to a plurality of ejecting heads via a pressure regulating valve, and the liquid is suctioned from the plurality of ejecting heads by a circulation pump, and then is discharged to the liquid storage unit. In this way, since the liquid is suctioned from each of the ejecting heads, the passage resistance is decreased, so that the ink can be appropriately circulated. In addition, since the ejecting head is supplied with the liquid at an appropriate pressure from the liquid storage unit via the pressure adjusting valve, the liquid can be appropriately ejected.

12 Claims, 10 Drawing Sheets

(56) References Cited

U.S. PATENT DOCUMENTS

| | | | | |
|---|---|---|---|---|
| 8,197,046 | B2 | 6/2012 | Asami | |
| 8,272,719 | B2 | 9/2012 | Inoue et al. | |
| 8,403,439 | B2 | 3/2013 | Tanaka | |
| 8,403,467 | B2 | 3/2013 | Asami | |
| 8,794,747 | B2 * | 8/2014 | Enomoto et al. | 347/85 |
| 2002/0075367 | A1 | 6/2002 | Chiu | |
| 2002/0113836 | A1 | 8/2002 | Sonobe | |
| 2002/0196318 | A1 | 12/2002 | Shimizu | |
| 2005/0052513 | A1 | 3/2005 | Inoue | |
| 2005/0062815 | A1 | 3/2005 | Yoshihira et al. | |
| 2005/0212874 | A1 * | 9/2005 | Nomura et al. | 347/84 |
| 2006/0082621 | A1 | 4/2006 | Tsukada et al. | |
| 2007/0120913 | A1 | 5/2007 | Mukai et al. | |
| 2007/0216739 | A1 | 9/2007 | Uchida et al. | |
| 2008/0007579 | A1 * | 1/2008 | Furukawa et al. | 347/6 |
| 2008/0079791 | A1 | 4/2008 | Kang et al. | |
| 2008/0151021 | A1 | 6/2008 | Miyazawa | |
| 2008/0210160 | A1 * | 9/2008 | Namekawa et al. | 118/300 |
| 2008/0239013 | A1 | 10/2008 | Hirashima | |
| 2009/0179972 | A1 * | 7/2009 | Yamamoto | 347/85 |
| 2009/0219367 | A1 | 9/2009 | Owaki et al. | |
| 2009/0267976 | A1 | 10/2009 | Lee et al. | |
| 2009/0267988 | A1 | 10/2009 | Matsui et al. | |
| 2010/0085396 | A1 * | 4/2010 | Yokota | B41J 2/14233 347/7 |
| 2010/0110155 | A1 | 5/2010 | Delueg | |
| 2010/0188454 | A1 * | 7/2010 | Murakami | B41J 2/17596 347/14 |
| 2010/0245411 | A1 | 9/2010 | Kato et al. | |
| 2011/0211029 | A1 * | 9/2011 | Enomoto et al. | 347/93 |
| 2011/0316904 | A1 * | 12/2011 | Isozaki et al. | 347/6 |
| 2012/0033003 | A1 | 2/2012 | Tanaka et al. | |

FOREIGN PATENT DOCUMENTS

| | | | |
|---|---|---|---|
| JP | 4-214363 | A | 8/1992 |
| JP | 11-058786 | A | 3/1999 |
| JP | 2006-122814 | A | 5/2006 |
| JP | 2007-069419 | A | 3/2007 |
| JP | 2007-118540 | A | 5/2007 |
| JP | 2008-246843 | A | 10/2008 |
| JP | 2008-260311 | A | 10/2008 |
| JP | 2008-273027 | A | 11/2008 |
| JP | 2008-290292 | A | 12/2008 |
| JP | 2009-143087 | A | 7/2009 |
| JP | 2009-248412 | A | 10/2009 |
| JP | 2009-262360 | A | 11/2009 |

* cited by examiner

LIQUID EJECTING APPARATUS

CROSS REFERENCES TO RELATED APPLICATIONS

This application is a continuation of U.S. patent application Ser. No. 13/038,301, filed Mar. 1, 2011, which claims the priority to Japanese Patent Application No. 2010-043858, filed Mar. 1, 2010, the entire disclosures of which are incorporated by reference herein.

BACKGROUND

1. Technical Field

The present invention relates to a technology of ejecting a liquid, which is received in a container, from ejecting nozzles provided in an ejecting head.

2. Related Art

There is known a liquid ejecting apparatus including an ejecting head for ejecting a liquid which is received in a container. The ejecting head of the liquid ejecting apparatus is provided therein with a liquid chamber supplied with the liquid, and ejecting nozzles for ejecting the liquid. If a pressurizing mechanism provided in the liquid chamber is driven to pressurize the liquid, the liquid is ejected from the ejecting nozzles. Since the liquid is ejected in the above manner, if bubbles mixed and supplied with the liquid are accumulated in the liquid chamber, the liquid in the liquid chamber is not able to be appropriately pressurized, and thus it is difficult to eject the liquid from the ejecting nozzles. In addition, in order to be able to eject a lot of liquid at a time, a liquid ejecting apparatus has been developed to supply the liquid from the container to a plurality of ejecting heads and eject the liquid from the ejecting heads at the same time. However, in such a liquid ejecting apparatus, circumstances in which the bubbles are accumulated in the liquid chamber occur more easily as the ejecting heads are increased. Accordingly, the liquid ejecting apparatus including the plurality of ejecting heads for ejecting the liquid employs a configuration, in which the liquid supplied to the ejecting heads is not collected in the ejecting heads until the fluid is ejected, but the fluid is circulated in an inside and an outside of the ejecting heads by discharging the fluid outward from the ejecting heads and again supplying it into the ejecting heads so as not to accumulate the bubbles in the liquid chamber.

In addition, in the configuration for circulating the liquid in the liquid ejecting apparatus including the plurality of ejecting heads, as described above, a structure in which the ejecting heads are connected in series to each other, and a structure in which the ejecting heads are connected in parallel to each other, are proposed. Here, the expression "structure in which the ejecting heads are connected in series to each other" means that the liquid circulated in any ejecting head and then discharged outward from the ejecting head is supplied to the ejecting head at a downstream side, so that the liquid is circulated in sequence in the plurality of ejecting heads. In addition, the expression "structure in which the ejecting heads are connected in parallel to each other" means that a passage for circulating the liquid is branched along the way, and thus the plurality of ejecting heads are connected in parallel to each other, so that the liquid is independently circulated in each ejecting head.

In the structure in which the ejecting heads are connected in series to each other, a pressure difference between the pressure of the liquid supplied to the ejecting heads located at the upstream side and the pressure of the liquid supplied to the ejecting head located at the downstream side is increased due to the pressure loss occurring in the ejecting heads. As a result, it is difficult to reliably eject the liquid from each of the ejecting heads. Meanwhile, in the structure in which the ejecting heads are connected in parallel to each other, due to influences, such as a difference in the shape or length of the passages for circulating the liquid or the like, ejecting heads which can easily circulate the liquid therein and ejecting heads which have difficulty circulating the liquid therein can be generated. In the case where the ejecting heads which have difficulty circulating the fluid are generated, it is difficult to discharge the bubbles from the interior of the ejecting heads.

Accordingly, there is provided a technology capable of being shifted between the state where the plurality of ejecting heads are connected in series to each other and the state where the plurality of ejecting heads are connected in parallel to each other, in which when the liquid is ejected, the plurality of ejecting heads are connected in parallel to each other, while when the bubbles are discharged, the plurality of ejecting heads are connected in series to each other (JP-A-2008-246843).

However, since the state where the plurality of ejecting heads are connected in series to each other and the state where the plurality of ejecting heads are connected in parallel to each other are shifted between in the proposed technology, a complicated configuration is needed. In addition, since the flow passage of the fluid has a complicated shape, the passage resistance is increased. In addition, a switching structure is added, and thus the passage resistance is further increased. Furthermore, since the plurality of ejecting heads are connected in series to each other when the liquid is circulated, the passage resistance is gradually increased. As a result, there is a problem that since a huge load is exerted on a circulation pump, a circulation pump with a large capacity is needed.

SUMMARY

An advantage of some aspects of the invention is to provide a technology capable of avoiding a huge load from being exerted on a circulation pump while circulating a liquid to be supplied to a plurality of ejecting heads, and appropriately ejecting the liquid from the plurality of ejecting heads.

In order to address at least one of the above-described problems, a liquid ejection apparatus of the invention employs the following configuration.

According to an aspect of the invention, there is provided a liquid ejecting apparatus which supplies a liquid, which is received in a liquid container, to a plurality of ejecting heads, and ejects the liquid from ejecting nozzles of the ejecting heads, the liquid ejecting apparatus including: a liquid storage unit which is provided at an upstream side of the plurality of ejecting heads, and stores the liquid supplied to the ejecting heads; a pressure regulating valve which is provided between the liquid storage unit and the plurality of ejecting heads, and opens a valve if a pressure of the liquid inside the ejecting heads is dropped to a predetermined pressure or less, so that the liquid received from the liquid storage unit side is supplied to the ejecting heads to regulate the pressure of the liquid inside the ejecting heads; and a circulation pump which suctions the liquid inside the ejecting heads from a liquid circulation port provided in the plurality of ejecting heads to discharge the liquid to the liquid storage unit, thereby circulating the liquid between the plurality of ejecting heads and the liquid storage unit.

In the liquid ejecting apparatus according to the invention, the liquid stored in the liquid storage unit is supplied to the plurality of ejecting heads via the pressure regulating valve, and suctions the liquid from the liquid circulation port provided in the plurality of ejecting heads to return the liquid to the liquid storage unit. For this reason, since the circulation suctions the liquid from each ejecting head, a passage resistance generated when the liquid is suctioned is not increased, thereby avoiding an excessive load from exerting on the circulation pump. In addition, if the pressure of the liquid inside the ejecting head is dropped by the circulation pump, the pressure regulating valve opens the valve to supply the liquid from the liquid storage unit to the ejecting heads. That is, if the liquid inside the ejecting head is suctioned by the circulation pump, since the liquid which is equal to the suctioned amount is supplied from the liquid storage unit via the pressure regulating valve, it is possible to constantly maintain the pressure of the liquid inside each ejecting head in an appropriate pressure range. As a result, in a case where a lot of ejecting heads are mounted, it is possible to completely and easily discharge bubbles inside the ejecting heads, and appropriately eject the liquid from each ejecting head.

In addition, the above-described liquid ejecting apparatus according to the invention may include the following configuration. First, the ejecting head includes a head filter interposed between a liquid inlet for receiving the liquid from the liquid storage unit, and ejecting nozzles to capture foreign substances mixed with the liquid. Further, the head filter communicates with the liquid inlet and a first liquid circulation port is provided therebetween. The head filter communicates with the ejecting nozzles and a second liquid circulation port is provided therebetween. The liquid inside the ejecting head may be suctioned from at least one of the first liquid circulation port and the second liquid circulation port, thereby circulating the liquid.

In such a way, since the foreign substances mixed into the ejecting heads with the liquid are captured by the head filter, it is possible to prevent the foreign substances from being stuck in the ejecting nozzles. In addition, even though the bubbles mixed with the liquid stay in the head filter portion, the bubbles can be eliminated by suctioning the liquid from the first liquid circulation port. Further, in a case where the bubbles are introduced into the downstream side (ejecting nozzle side) of the head filter due to being escaped from the head filter or the like, it is possible to eliminate the bubbles by suctioning the liquid from the second liquid circulation port. As a result, the bubbles inside the ejecting head are reliably eliminated while preventing the problem from occurring due to the foreign substances, so that the liquid can be appropriately ejected. In addition, since a sufficient flow velocity of the liquid can be easily ensured by suctioning the liquid from any one of the first liquid circulation port and the second liquid circulation port, it is possible to easily eliminate the bubbles inside the ejecting head.

Furthermore, in the above-described liquid ejecting apparatus according to the invention, a tank filter for capturing the foreign substances mixed with the liquid may be provided between the liquid storage unit and the pressure regulating valve.

In this way, since the foreign substances are captured by the tank filter provided at the upstream side of the pressure regulating valve even in the case where the foreign substances are mixed with the liquid, it is not necessary to provide the head filter in the ejecting head. For this reason, it is possible to miniaturize the ejecting head. In addition, since the inside of the ejecting head is not portioned by the head filter, a liquid circulation port for suctioning the liquid inside the ejecting head is not necessarily provided at two portions of the head filter, that is, the upstream side and the downstream side, but provided at one portion. The significance of which being that it becomes possible to miniaturize the ejecting head. In addition, since the liquid passage for suctioning the liquid from the interior of the ejecting head is formed by one line, it is possible to alleviate the load exerting on the circulation pump. Further, since the pressure regulating valve is provided with the tank filter at the upstream side thereof, foreign substances do not flow into the pressure regulating valve, and thus there is no fear that the foreign substances cause abnormalities in the operation of the pressure regulating valve. In addition, even though the bubbles stay in a part of the tank filter, since the liquid storage unit is located at the upstream side in the vicinity of the bubbles, the bubbles return to the liquid storage unit soon, if the flow of the liquid is stopped. For this reason, it is not necessary to positively circulate the liquid at the upstream side of the tank filter. At that time, if the upstream side of the tank filter directly forms the liquid storage unit without involving the passage, the possibility in which the bubbles stay in the portion of the tank filter can be further reduced.

In this instance, the above-described liquid ejecting apparatus according to the invention can employ the following pressure regulating valve. That is, the pressure regulating valve employed in the liquid ejecting apparatus according to the invention may include a first liquid chamber connected to the liquid storage unit, a second liquid chamber spaced apart from the first liquid chamber by a partition and connected to the ejecting head, a communication hole formed by punching the partition to communicate the first liquid chamber with the second liquid chamber, a valve seat formed at an opening portion of the communication hole at the first liquid chamber side, a valve body slidably inserted into the communication hole, in which if the valve body is slid in the communication hole toward the second liquid chamber side, an end portion of the liquid chamber side comes into contact with the valve seat to seal the communication hole, a biasing member for biasing the valve body in a direction of the second liquid chamber, and a spacing member which slides the valve body in the direction of the first liquid chamber to space the end portion of the valve body from the valve seat, if a pressure of the liquid inside the second liquid chamber is decreased.

With the pressure regulating valve having the above-described configuration, for example, even if the high pressure of liquid is applied to the first liquid chamber side, the end portion of the valve body is pressed against the valve seat by the pressure of the liquid to seal the communication hole, so that the pressure variation inside the first liquid chamber does not reach the second liquid chamber. Meanwhile, if the pressure of the liquid inside the second liquid chamber is decreased, the valve body is slid toward the first liquid chamber, and thus the end portion of the valve body in the first liquid chamber side is spaced apart from the valve seat. For this reason, since the liquid is supplied from the first liquid chamber to the second liquid chamber, the pressure of the liquid inside the second liquid chamber can be quickly recovered. As a result, the pressure of the liquid inside the second liquid chamber is maintained in a constant range of the pressure, so that the liquid can be constantly supplied to the ejecting head at the constant pressure.

Further, according to the above-described liquid ejecting apparatus according to the invention, the liquid supply passage, through which the liquid is supplied from the pressure regulating valve to the ejecting head, is branched in midstream, so that the liquid is supplied from one pressure regulating valve to the plurality of ejecting heads.

In this way, since one pressure regulating valve can be used in common in the plurality of ejecting heads, the number of components is reduced. Therefore, it is possible to obtain technical effects such as miniaturization of the liquid ejecting apparatus, improved reliability regarding breakdown, or the like.

Furthermore, the above-described liquid ejecting apparatus according to the invention may include a liquid supply passage which supplies the liquid from the liquid container to the liquid storage unit, a liquid circulation passage which circulates the liquid, which is suctioned from the liquid circulation port of the ejecting head, in the liquid storage unit, and a switching valve which is connected to the circulation pump to switch the liquid supply passage and the liquid circulation passage.

In this way, since the pump for supplying the liquid from the liquid container to the liquid storage unit and the circulation pump for circulating the liquid supplied to the ejecting head can be used in common, the number of components is reduced. Therefore, it is possible to obtain technical effects such as miniaturization of the liquid ejecting apparatus, improved reliability regarding breakdown, or the like.

In addition, the above-described liquid ejecting apparatus according to the invention can have the following configuration. That is, the passage for supplying the liquid from the pressure regulating valve to the ejecting head may be provided with a first check valve which prevents the liquid from flowing back from the ejecting head in the direction of the pressure regulating valve, and the passage connected to the liquid circulation port of the ejecting head may be provided with a second check valve which prevents the liquid suctioned from the liquid circulation port from flowing back into the ejecting head.

In this way, in the case where the negative pressure is exerted on any ejecting nozzle of the ejecting head to suck the liquid inside the ejecting head, since the negative pressure is not exerted on other ejecting heads, it is possible to avoid the bubbles from suctioning from the ejecting nozzles of other ejecting heads.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
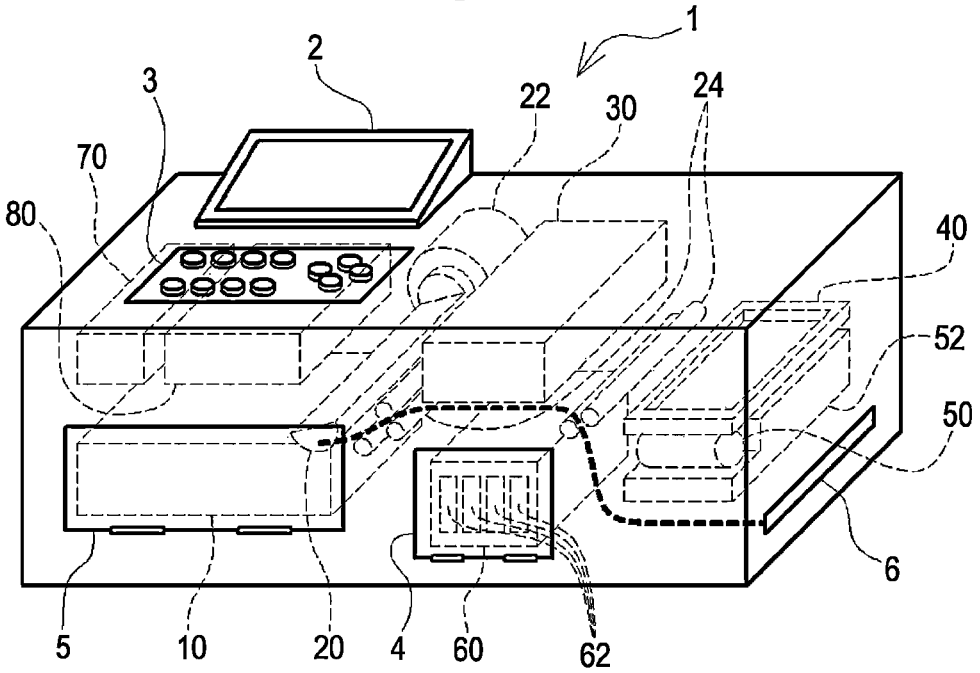
FIG. 1 is a diagram schematically illustrating the configuration of a liquid ejecting apparatus according to an embodiment in which a line printer is used as an example.

Embodiments will now be described in the following order so as to make clear the above-described contents of the invention:

A. Configuration of Line Printer;
B. Configuration of Ink Circulation System;
C. Operation of Ink Circulation System; and
D. Modified Example A. Configuration of Line Printer FIG. 1 is a diagram schematically illustrating the configuration of a liquid ejecting apparatus according to an embodiment in which a line printer 1 is used as an example. As shown in the drawing, a line printer 1 according to the embodiment has a substantially box-like outer shape, and is provided on an upper surface thereof with a monitor panel 2 and an operation panel 3 which is operated by a user. In addition, a front surface of the line printer 1 is provided with a cartridge exchange door 4 for exchanging an ink cartridge, and a sheet feeding door 5 for loading a printing sheet. Further, a right surface is provided with a sheet discharge port 6 through which a printed printing sheet is discharged.

The line printer 1 is provided therein with a plurality of units or components for executing various functions. First, a head unit 30 for ejecting ink onto a printing sheet is provided at a substantially central position of the line printer 1. An ink supply unit 60 for supplying the ink to the head unit 30 is provided under the head unit 30, and an ink cartridge 62 filled with the ink is mounted into the ink supply unit 60. In this instance, the line printer 1 according to the embodiment can use ink of four colors, such as black ink (K ink), cyan ink (C ink), magenta ink (M ink), and yellow ink (Y ink), during printing, and four ink cartridges 62 each filled with the respective ink of the four colors are mounted into the ink supply unit 60.

On a paper surface of FIG. 1, a sheet feeding cassette 10 loaded with printing sheets is provided at a position under the left side of the head unit 30, and a sheet feeding roller 20 is provided at a position which comes into contact with an upper surface of a right end portion of the sheet feeding cassette 10. In addition, a sheet feeding motor 22 is connected to a rear side of the sheet feeding roller 20. If the sheet feeding roller 20 is rotated by driving the sheet feeding motor 22, the printing sheets are transported one by one to the head unit 30 from the sheet feeding cassette 10. In this instance, a transport path of the printing sheets is indicated by a thick short-dashed line in FIG. 1.

In addition, on the paper surface of FIG. 1, a right area of the head unit 30 is an empty space, and a cap 40, a suction pump 50, and a waste liquid tank 52 are provided under the empty space. In the line printer 1 according to the embodiment, in a case where a property of the ink inside the head unit 30 is deteriorated with the lapse of time or the like, after the head unit 30 is moved in the right side to the empty space, the suction pump 50 is operated under the state where the bottom side of the head unit 30 is pressed and covered by the cap 40, so that the ink with the deteriorated property can be suctioned out. Further, the ink suctioned by the suction pump 50 is collected in the waste liquid tank 52.

Further, a power source unit 70 for supplying a power to the line printer 1, and a control unit 80 for controlling various operations of the line printer 1 are provided just below the portion in which the monitor panel 2 and the operation panel 3 are installed.

The line printer 1 including the above-described configuration prints an image in the following manner. First, if the sheet feeding cassette 10 is loaded with a plurality of printing sheets, the printing sheet is pushed up by a spring (not illustrated), and thus is pressed down by the sheet feeding roller 20 which is provided at the upper side. The sheet feeding roller 20 is an elongated member of a substantially semicircular cross section which is formed by dividing an elongated metallic circular column into halves in a longitudinal direction. A lateral surface corresponding to a circumferential portion is made of a rubber material. One end portion of the sheet feeding roller 20 is connected to the sheet feeding motor 22, and the sheet feeding roller 20 is driven and rotated by the sheet feeding motor 22, so that the printing sheets are delivered to the head unit 30 from the sheet feeding cassette 10 one by one.

A plurality of guide rollers 24 is interposed between the sheet feeding roller 20 and the head unit 30. The guide rollers 24 are driven and rotated by a motor (not illustrated) to transport the printing sheet to the head unit 30 while guiding the printing sheet.

Figure 2:
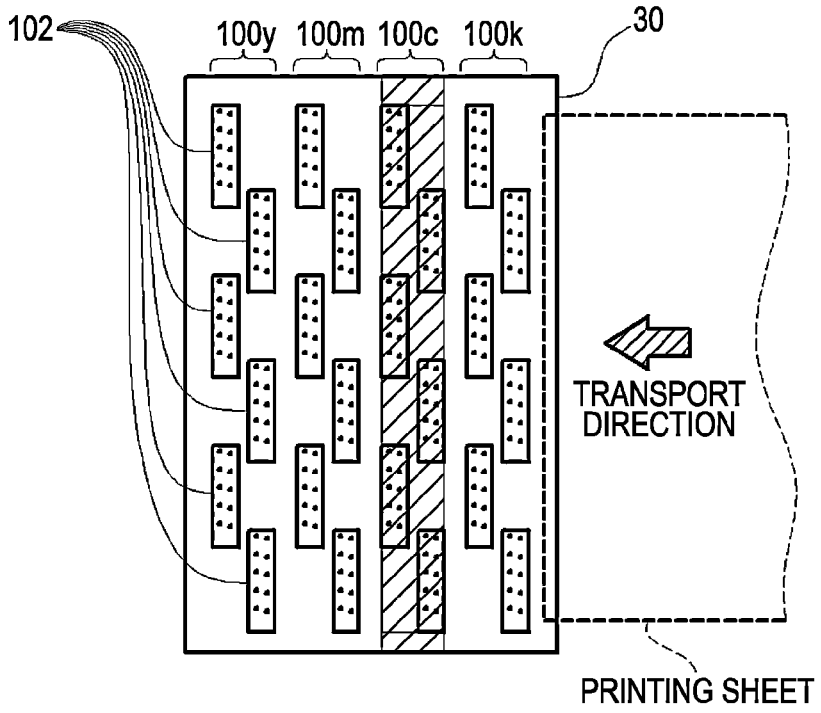
FIG. 2 is a diagram illustrating the state where a head unit is seen from a bottom side.

The head unit 30 is installed in a state where the head unit straddles the printing sheet on a transport path of the printing sheet, and is provided with a plurality of ejecting heads for ejecting the ink at the bottom side (that is, a side facing the printing sheet) of the head unit 30 (refer to FIG. 2). In addition, the head unit 30 is connected to the ink cartridge 62 of the ink supply unit 60 via a passage (not illustrated), in which the ink contained in the ink cartridge 62 is ejected from the plurality of ejecting heads provided at the bottom side of the head unit 30.

FIG. 2 is a diagram illustrating the state where a head unit 30 is seen from a bottom side (the side facing the printing sheet). As shown in the drawing, 4 sets of ejecting heads 102 (24 in total) of a substantially rectangular shape, in which one set of ejecting heads is formed by six ejecting heads, are provided at the bottom surface of the head unit 30 according to the embodiment. In addition, in each set of six ejecting heads 102, 2 rows of three ejecting heads 102 are arranged, and are also alternatively arranged. Further, each ejecting head 102 is provided with a plurality of rows of ejecting nozzles for ejecting the ink. In this instance, the lower surface of the ejecting head 102, on which the ejecting nozzles are provided, is referred to as a "nozzle surface".

The ejecting heads 102 are alternatively arranged to constitute one ejection unit 100 in which six ejecting heads 102 are integrally formed. As described above, since the head unit 30 according to the embodiment is provided with 24 ejecting heads 102, eventually four ejection units are installed. Each of the ejection units 100 is formed of an ejection unit 100*y* for ejecting Y ink, an ejection unit 100*m* for ejecting M ink, an ejection unit 100*c* for ejecting C ink, and an ejection unit 100*k* for ejecting K ink.

Under the head unit 30, a platen (not illustrated) supporting the printing sheet from a rear surface is provided in such a manner that the platen faces the bottom surface of the head unit 30. The printing sheet transported by the sheet feeding roller 20 and the guide roller 24 is transported over the platen. During this time, the ink is ejected from the plurality of ejecting heads 102 provided at the bottom surface of the head unit 30, so that the image is printed on the printing sheet. The printing sheet printed with the image by the above manner is bent by the guide roller 24 provided at the downstream side of the head unit 30 in such a manner that a traveling direction faces downward. After that, the printing sheet is discharged outwardly from the discharge port 6 through the lower portion of the waste liquid tank 52 to the exterior of the line printer 1.

As described above, since the line printer 1 according to the embodiment includes the head unit 30 formed by the plurality of ejecting heads 102, and the printing sheet passes below the head unit 30 to print the image, it is possible to quickly print the image. However, if bubbles are mixed with any one of a plurality of ejecting heads 102, the ink is not appropriately ejected from the ejecting head 102, and thus there is a fear that the image cannot be appropriately printed. Accordingly, in the case where the bubbles are mixed in, the head unit 30 is moved to the position of the cap 40, and then a flushing operation of ejecting the ink toward the cap 40 or a cleaning operation of suctioning the ink by pushing down the cap 40 against the bottom side of the head unit 30 is carried out to discharge the bubbles together with the ink. However, since the plurality of ejecting heads 102 are mounted, whenever the bubbles are mixed in, the flushing operation or the cleaning operation is carried out, thereby increasing consumption amounts of the ink. Accordingly, in the line printer 1 according to the embodiment, the ink supplied to the ejecting head 102 is circulated by the following manner to process the bubbles mixed into the ink, so that the ink can be appropriately ejected from the ejecting head 102. In addition, an excessive load is not exerted on the circulation pump for circulating the ink. Next, the ink circulation system employed in the line printer 1 according to the embodiment will be described.

B. Configuration of Ink Circulation System

Figure 3:
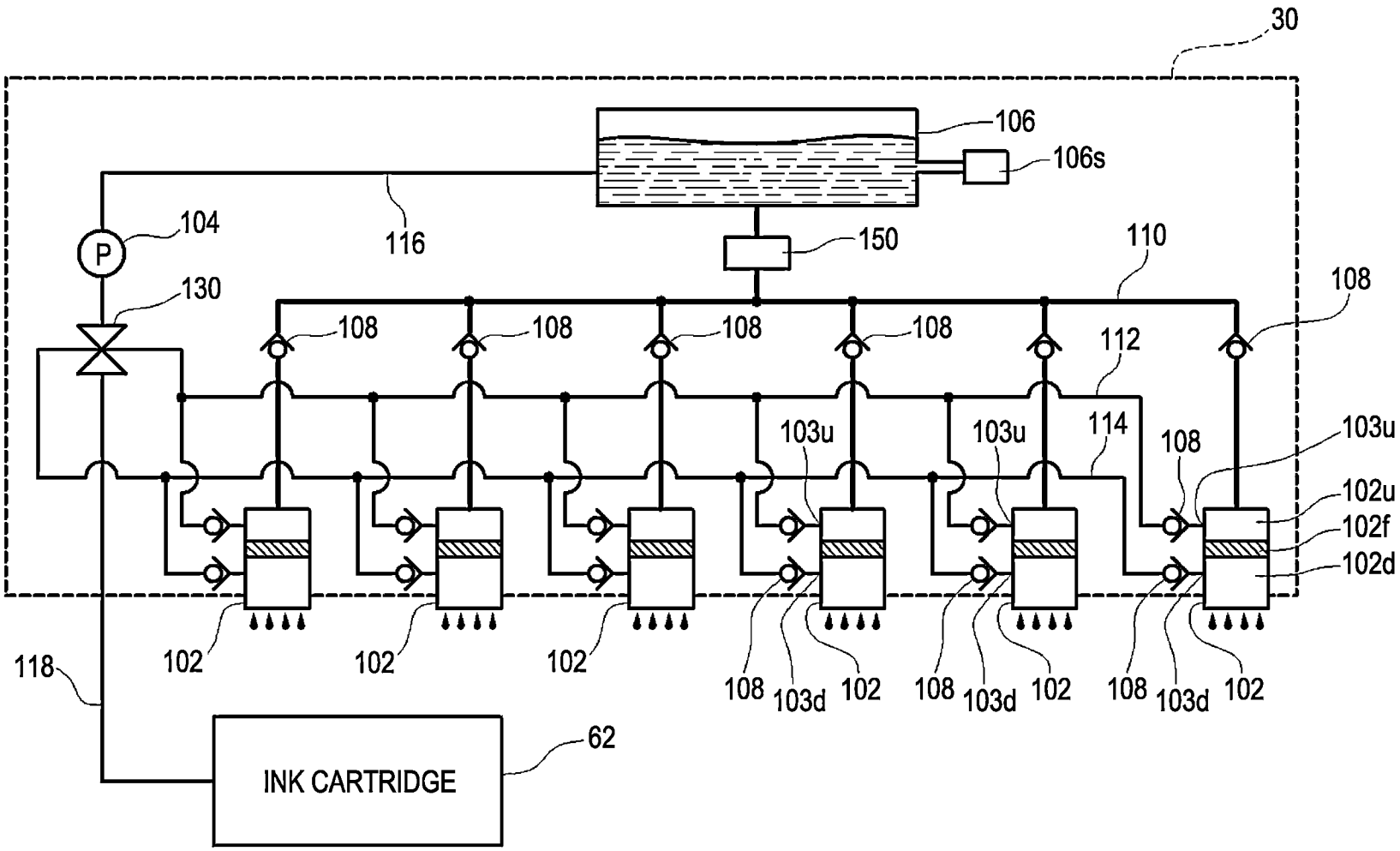
FIG. 3 is a diagram illustrating the configuration for circulating ink which is supplied to an ejecting head in a line printer according to the embodiment.

FIG. 3 is a diagram illustrating the configuration of the ink circulation system employed in the line printer 1 according to the embodiment. In this instance, as hereinbefore described with reference to FIGS. 1 and 2, four kinds of ink, such as C (cyan) ink, M (magenta) ink, Y (yellow) ink, and K (black) ink, are mounted in the line printer 1 according to the embodiment. The ink is supplied to the ejecting heads 102 of the ejecting unit 100 which are provided according to the kinds of the ink. The ink circulation system circulates the ink for every ejection unit 100. However, since the configuration of each ink circulation system is completely identical to each other, only one ejection unit 100 is illustrated as a typical example in FIG. 3.

As hereinafter described with reference to FIG. 2, the ejection unit 100 includes six ejecting heads 102, and six ejecting heads 102 are correspondingly illustrated in FIG. 3. The ink is supplied from the inside of the ink cartridge 62 to six ejecting heads 102. The passage for supplying the ink inside the ink cartridge 62 to the ejecting head 102 is configured as follows. First, the ink cartridge 62 (liquid container) is connected to the circulation pump 104 via the ink passage 118 and the switching valve 130, and the circulation pump 104 is connected to the sub tank 106 (liquid storage unit) via the ink passage 116. Although described in detail hereinafter, the sub tank 106 is stored with the ink supplied to the ejecting heads 102, and has a function of separating the bubbles mixed into the ink. In addition, the sub tank 106 is provided with a liquid level sensor 106*s* to detect a liquid level (position of ink liquid surface) of the ink stored in the sub tank 106. In this instance, the liquid level sensor 106*s* may not detect the position of the ink liquid surface, but may detect a reduction of the ink liquid surface to a predetermined position. In addition, instead of detecting the position of the ink liquid surface, a hydraulic head pressure of the ink may be detected.

Further, the pressure regulating valve 150 is connected to the downstream side of the sub tank 106. Although the pressure regulating valve 150 will be described in detail hereinafter, if the pressure of the downstream side (ejecting head 102 side) is decreased, the pressure regulating valve 150 has a function of automatically opening the valve to receive the ink so that the ink is constantly supplied at an appropriate pressure to the ejecting heads 102. After the ink supply passage 110 is branched at the downstream side of the pressure regulating valve 150, and is connected to the ejecting heads 102 via the check valve 108. In FIG. 3, the ink supply passage 110 from the sub tank 106 to the ejecting head 102 is indicated by a thick solid line.

In the line printer 1 according to the embodiment, the ejecting head 102 is provided with a head filter 102*f* therein, and the ink is supplied to the ejecting nozzles via the head filter 102*f*. For this reason, although the foreign substances are mixed into the ink, the foreign substances are removed by the head filter 102*f*, so that the ejecting nozzles are not likely to get clogged.

The passage for circulating the ink inside the ejecting heads 102 is configured as follows. First, a filter upstream chamber 102*u* (upstream side portion of the head filter 102*f* in each ejecting head 102) inside the ejecting head 102 is provided with a first circulation port 103*u* (first liquid circulation port), and the circulation passage 112 of the ink is connected to the first circulation portion 103*u* via the check valve 108. Each circulation passage 112 from the first circulation port 103*u* which is installed at the filter upstream chamber 102*u* of each ejecting head 102 joins together, and then is connected to the switching valve 130. In addition, a filter downstream chamber 102*d* inside the ejecting head 102 (downstream side portion of the head filter 102*f* in each ejecting head 102) is provided with a second circulation port 103*d* (second liquid circulation port), and the second circulation port 103*d* is connected to the circulation passage 114 of the ink via the check valve 108. The circulation passage 114 from each second circulation hole 103*d* installed at the filter downstream chamber 102*d* of each ejecting head 102 joins together, and then is connected to the switching valve 130. The circulation passage 112 connected to the filter upstream chamber 102*u* is referred to as an upstream-side circulation passage 112, and the circulation passage 114 connected to the filter downstream chamber 102*d* is referred to as a downstream-side circulation passage 114.

In the ink circulation system including the above-described configuration according to the embodiment, the ink stored in the sub tank 106 (liquid storage unit) is supplied to the plurality of ejecting heads 102 via the pressure regulating valve 150. For this reason, if the ink is ejected from the ejecting head 102, the ink is supplied from the sub tank 106 by as much as the ejected amount. As a result, the pressure of the ink from the pressure regulating valve 150 to the ejecting head 102 is constantly regulated at the constant pressure. The pressure regulating valve 150 having the function will now be described.

Figure 4:
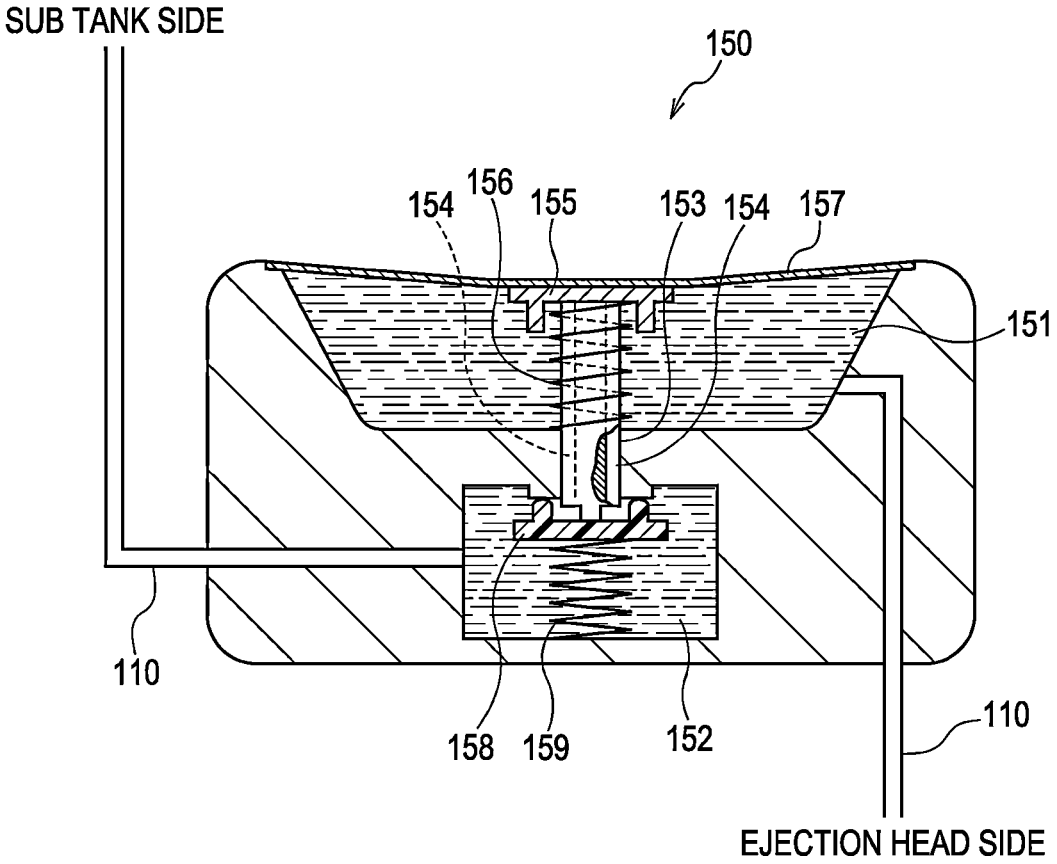
FIG. 4 is a diagram illustrating the detailed configuration of a pressure regulating valve.

FIG. 4 is a diagram illustrating the detailed configuration of the pressure regulating valve 150. In this instance, FIG. 4 shows an internal structure of the pressure regulating valve 150 by taking a longitudinal cross section passing the center of the pressure regulating valve 150. The pressure regulating valve 150 according to the embodiment is provided with two pressure chamber, that is, a pressure chamber 151 connected to the ejecting head 102, and a pressure chamber 152 connected to the sub tank 106. A partition spacing two pressure chambers is formed with a narrow passage. A passage shaft 153 having substantially the same diameter as the passage is slidably installed in the passage. The sidewall of the passage shaft 153 is provided with a plurality of passage grooves 154. One end portion of the passage groove 154 is opened toward the pressure chamber 151 side, and the other end portion is opened toward the pressure chamber 152 side.

A base member 155 is fixed to the end portion of the passage shaft 153 at the pressure chamber 151 side, and the base member 155 is lifted at a constant height from the bottom side of the pressure chamber 151 by a support spring 156 which is installed to enclose the passage shaft 153. In addition, the base member 155 is adhered to a substantially center position of a thin film 157 which forms one side (upper surface side in FIG. 4) of the pressure chamber 151.

In addition, the pressure chamber 152 side of the passage shaft 153 is provided with a rubber sealing valve 158 at the end portion thereof. The sealing valve 158 is lifted from the bottom side of the pressure chamber 152 by a sealing spring 159, and thus, the protruding portion formed on the upper side of the sealing valve 158 is generally pushed against the upper surface of the pressure chamber 152, thereby sealing the surroundings of the passage shaft 153 from the pressure chamber 152 side.

FIG. 5 is a diagram illustrating the operation of regulating the pressure of the ink supplied to the ejecting head 102 by the pressure regulating valve 150. As described above, the pressure regulating valve 150 is supplied with the ink from the sub tank 106 through the ink supply passage 110 (refer to FIG. 3). In this instance, the pressure chamber 152 of the pressure regulating valve 150 (pressure chamber of the sub tank 106 side) is supplied with the ink inside the sub tank 106 due to the difference in hydraulic head pressure. In addition, since the sealing valve 158 installed at the pressure chamber 152 side is pushed by the sealing spring 159, the passage groove 154 is closed by the sealing valve 158. Accordingly, in this instance, no ink is supplied to the pressure chamber 151 via the passage groove 154 from the pressure chamber 152.

Figure 5A:
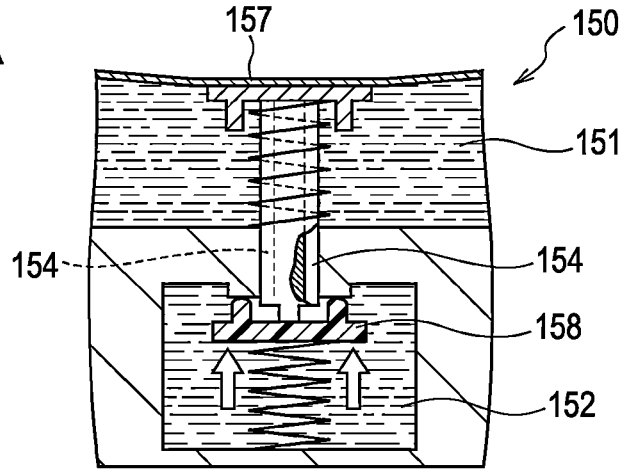
FIG. 5A to 5C are diagrams illustrating the operation of a pressure regulating valve to regulate a supply pressure of ink.
Figure 5B:
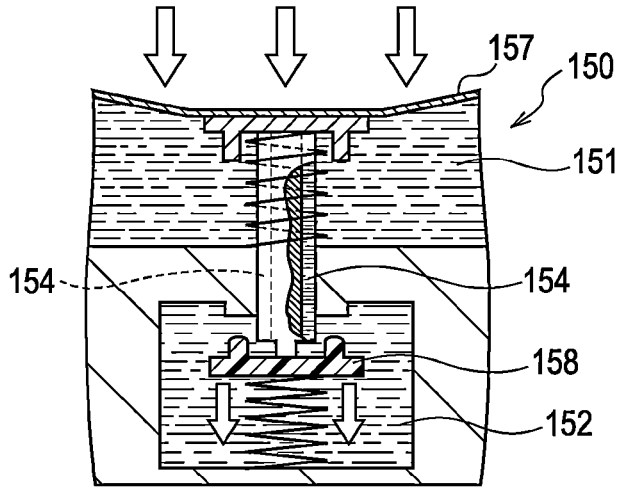
Figure 5C:
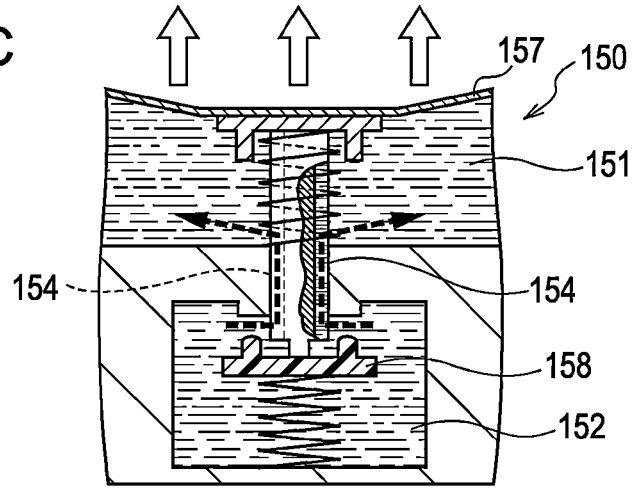

In the state shown in FIG. 5A, if the ink is ejected from the ejecting head 102, the ink is supplied to the ejecting head 102 from the pressure chamber 151 by as much as the ejected amount. As a result, as the ink is ejected from the ejecting head 102, the pressure inside the pressure chamber 151 is decreased. Since the upper surface side of the pressure chamber 151 is formed of the film 157, the film 157 is moved down due to the decreased pressure inside the pressure chamber 151. As a result, as shown in FIG. 5B, the passage shaft 153 and the base member 155 provided with the film 157 move against the repulsive force of the support spring 156. Then, the sealing valve 158 is pushed and opened by the passage shaft 153, and thus two pressure chambers (the pressure chamber 152 of the sub tank 106 side and the pressure chamber 151 of the ejecting head 102 side) communicate with each other via the passage groove 154 formed in the passage shaft 153. As a result, as shown by an arrow of a thick short-dashed line in FIG. 5C, the ink is supplied from the pressure chamber 152 of the sub tank 106 side to the pressure chamber 151 of the ejecting head 102 side via the passage groove 154.

If the pressure chamber 151 is supplied with the ink in this way, since the pressure inside the pressure chamber 151 is recovered, the film 157 is returned to its original state, and thus the base member 155 and the passage shaft 153 are returned to their original positions. As a result, as shown in FIG. 5A, the surroundings of the passage shaft 153 in the pressure chamber 152 side are again closed by the sealing valve 158, so that the supply of the ink to the pressure chamber 151 from the pressure chamber 152 is ended.

As described above, in the pressure regulating valve 150, the sealing valve 158 is generally closed. However, as the amount of the ink inside the pressure chamber 151 is reduced less than the predetermined amount, the sealing valve 158 is temporarily opened if the supply pressure of the ink in the pressure chamber 151 is decreased. Accordingly, the ink is supplied from the pressure chamber 152, so that the pressure of the ink in the pressure chamber 151 is recovered. Eventually, the ink is supplied by as much as the amount ejected from the ejecting head 102, so that the pressure of the ink supplied to the ejecting head 102 is constantly maintained. In this way, in the line printer 1 according to the embodiment, since the ejecting head 102 is supplied with the ink through the pressure regulating valve 150, the pressure of the ink supplied to the plurality of ejecting heads 102 can be constantly maintained. As a result, the unevenness in ejection amounts among the plurality of ejecting heads 102 can be suppressed, thereby printing of high quality images becomes possible.

In addition, as hereinbefore described with reference to FIG. 3, the ink passage 118 from the ink cartridge 62 (liquid container), the upstream-side circulation passage 112 from the filter upstream chamber 102*u* of the ejecting head 102, and the downstream-side circulation passage 114 from the filter downstream chamber 102*d* are connected to the circulation pump 104 via the switching valve 130. As the switching valve 130 switches the passage to be connected to the circulation pump 104, it is possible to switch an aspect of circulating the ink.

Figure 6A:
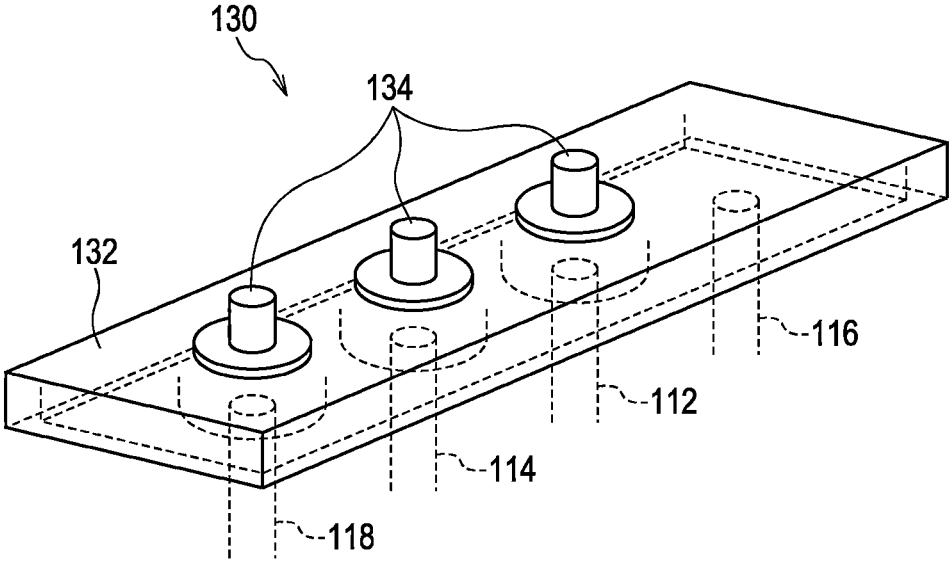
FIGS. 6A and 6B are perspective views illustrating a general shape of a switching valve.
Figure 6B:
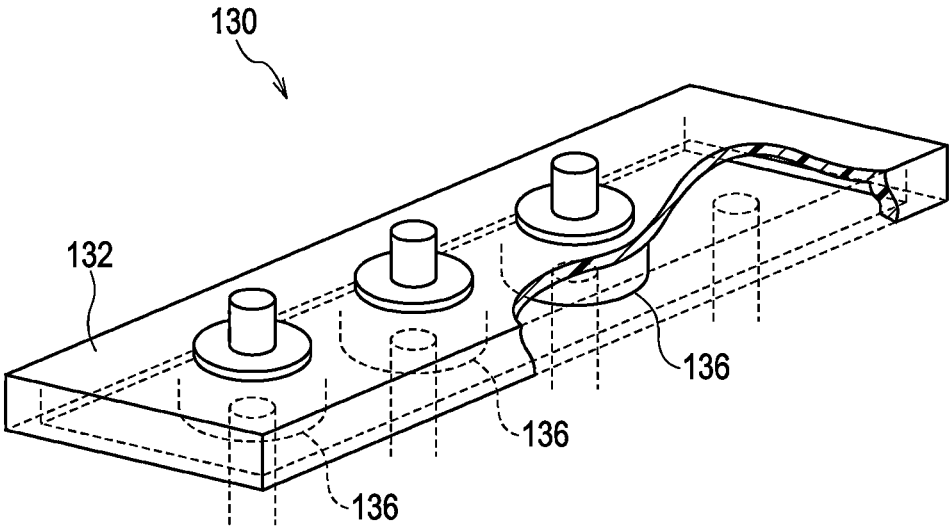

FIGS. 6A and 6B are perspective views schematically illustrating the general configuration of the switching valve 130 which is employed in the ink circulation system according to the embodiment. FIG. 6A shows the external appearance of the switching valve 130, and FIG. 6B shows the internal configuration of the switching valve 130 by cutting a portion thereof. As shown in FIG. 6A, the switching valve 130 has a rubber body case 132 of a substantially rectangular shape such as shallow container, in which an opening is lowered to face a bottom side. On the opening facing side of the body case 132, an ink passage 118 from the ink cartridge 62, an ink passage 116 connected to the circulation pump 104, an upstream-side circulation passage 112 from the ejecting head 102, and a downstream-side circulation passage 114 are opened. In addition, a metallic pushing member 134 is adhered to the upper surface of the body case 132 over the portion in which the ink passage 118 is opened. Similarly, metallic pushing members 134 are adhered to the upper surface of the body case 132 at the portions in which the upstream-side circulation passage 112 and the downstream-side circulation passage 114 are opened.

In addition, as shown in FIG. 6B, from a rear side of the portions of which the pushing members 134 are adhered to the upper surface of the body case 132, annular skirt portions 136 are vertically arranged to face the portions in which the ink passage 118, the upstream-side circulation passage 112, and the downstream-side circulation passage 114 are opened. The skirt portions 136 are also made of a rubber material, and can come into contact with the surroundings of the ink passages (the ink passage 118, the upstream-side circulation passage 112, and the downstream-side circulation passage 114) which are opened in the facing surface to seal the passages.

Figure 7:
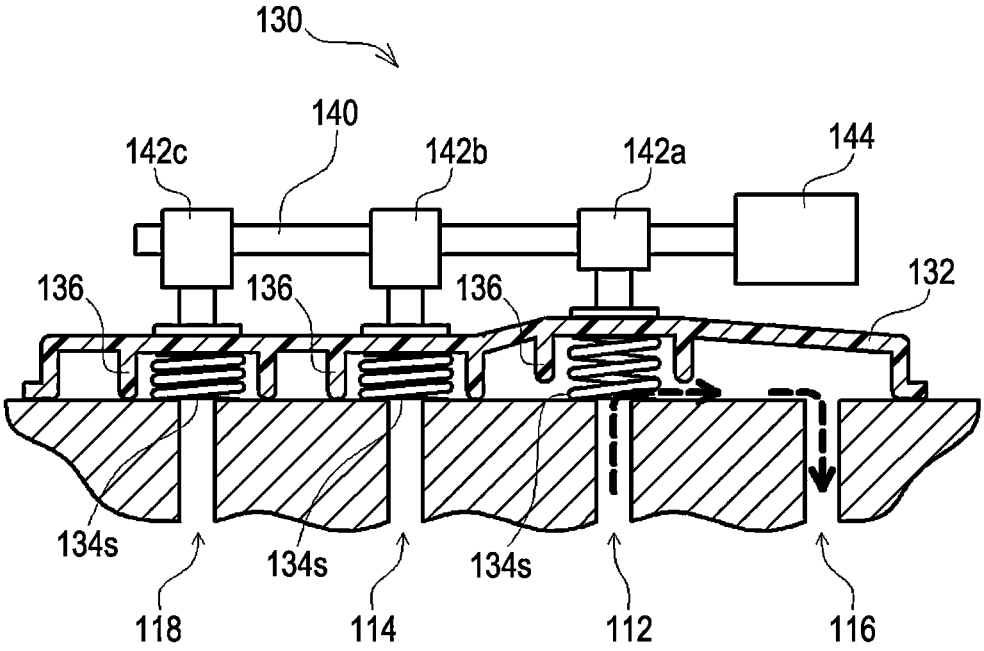
FIG. 7 is a cross-sectional view illustrating the detailed configuration of a switching valve.

FIG. 7 is a cross-sectional view illustrating the detailed configuration of the switching valve 130. As shown in the drawing, a coil spring 134*s* is provided at the portion in which the ink passage 118, the upstream-side circulation passage 112, and the downstream-side circulation passage 114 are opened. The skirt portions 136 vertically arranged on the rear side of the body case 132 is pushed up by the coil spring 134*s*, so that its front end portion does not come into contact with the surroundings of the opening portion. In addition, the body case 132 is provided above its upper portion with a cam shaft 140 with cam ridges 142*a*, 142*b* and 142*c*, and a motor 144 for rotating the cam shaft 140. If the cam shaft 140 is rotated, the cam ridges 142*a*, 142*b* and 142*c* push the upper surface of the body case 132 against the repulsive force of the coil spring 134*s* through the pressing member 134. The skirt portion 136 pushed down by the cam ridges comes into contact with the surroundings of the portion in which the ink passages are opened, thereby sealing the ink passage.

In the example shown in FIG. 7, the skirt portion 136 is pushed down by the cam ridge 142*c* and the cam ridge 142*b* at the portion in which the ink passage 118 from the ink cartridge 62 is opened, and at the portion in which the downstream-side circulation passage 114 is opened. As a result, the ink passage 118 and the downstream-side circulation passage 114 are sealed. However, the skirt portion 136 is not pushed down by the cam ridge 142*a* at the portion in which the upstream-side circulation passage 112 is opened, so that the upstream-side circulation passage 112 is not sealed. As a result, as indicated by an arrow of a thick short-dashed line in the drawing, the upstream-side circulation passage 112 communicates with the ink passage 116.

In addition, as the cam shaft 140 is rotated, if the cam ridges 142*a* and 142*c* push the skirt portion 136 down, but the cam ridge 142*b* does not push the skirt portion 136 down, the downstream-side circulation passage 114 can communicate with the ink passage 116. Similarly, if the cam ridges 142*a* and 142*b* push the skirt portion 136 down, but the cam ridge 142*c* does not push the skirt portion 136 down, the ink passage 118 can communicate with the ink passage 116. Of course, if only the cam ridge 142*c* pushes the skirt portion 136 down, but the cam ridges 142*b* and 142*a* do not push the skirt portion 136 down, the upstream-side circulation passage 112 and the downstream-side circulation passage 114 can communicate with the ink passage 116.

The switching valve 130 according to the embodiment is able to rotate the cam shaft 140 in this way, so that any one of the ink passage 118, the upstream-side circulation passage 112, and the downstream-side circulation passage 114 is selected and then switched to the passage communicating with the ink passage 116. In the ink circulation system according to the embodiment, the passage communicating with the ink passage 116 is switched to replenish the sub tank 106 with the ink from the ink cartridge 62 or circulate the ink supplied to the ejecting head 102 eliminating the bubbles mixed into the ink. As a result, it is possible to appropriately eject the ink from the ejecting head 102. Hereafter this point will be described in detail.

C. Operation of Ink Circulation System

Figure 8:
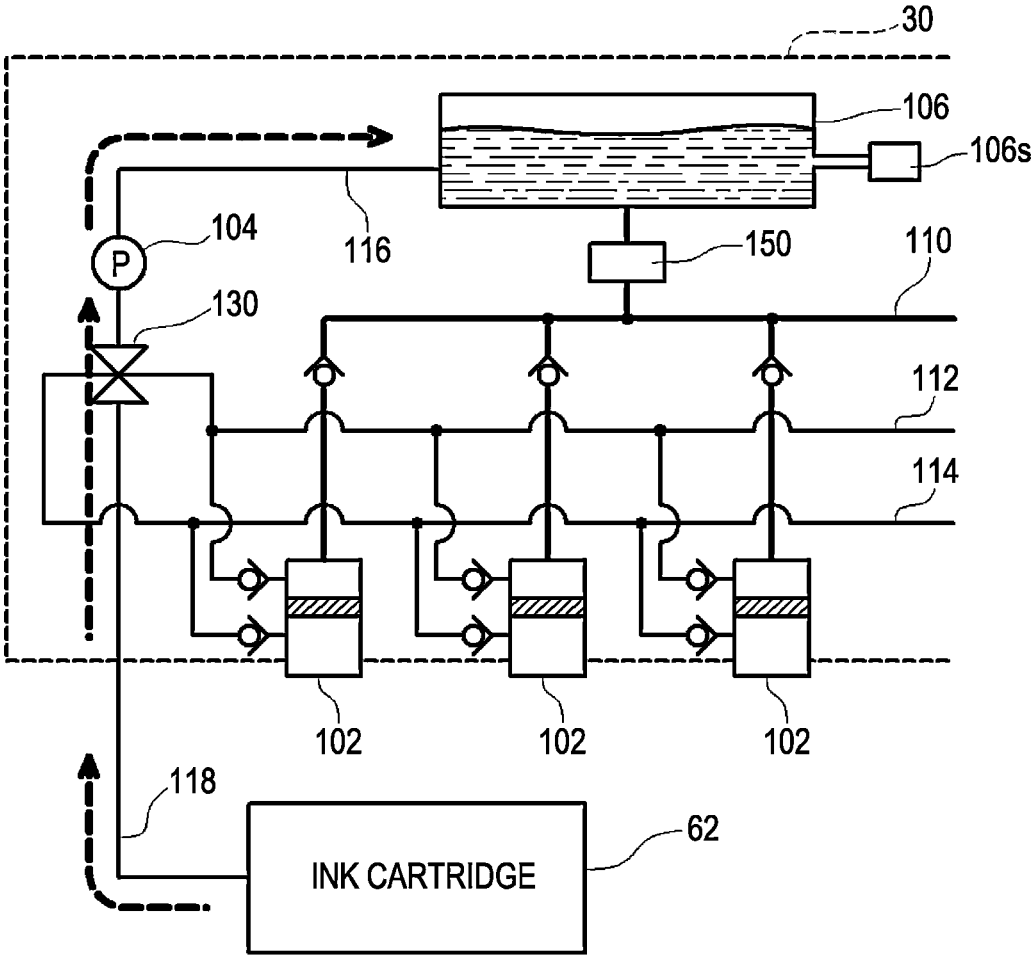
FIG. 8 is a diagram illustrating an aspect of supplying ink inside an ink cartridge to a sub tank.

FIG. 8 illustrates the operation of the ink circulation system according to the embodiment which supplies the ink from the ink cartridge 62 to the sub tank 106. The pressure of the ink supplied to the ejecting head 102 is constantly maintained by the pressure regulating valve 150. However, if the ink inside the sub tank 106 is not sufficient, it is not possible to supply the ink to the ejecting head 102 by the quantity needed. Accordingly, if the ink liquid surface detected by the liquid level sensor 106*s* is lowered, the sub tank 106 will be replenished with the ink from the ink cartridge 62. In this instance, the ink circulation system according to the embodiment performs the replenishment of the ink as follows.

First, the switching valve 130 communicates the ink passage 118 from the ink cartridge 62 with the ink passage 116 extended to the circulation pump 104. As described above with reference to FIG. 7, only the cam ridge 142*c* placed at the position corresponding to the ink passage 118 does not push the pressing member 134 down, and the cam ridges 142*a* and 142*b* located at other positions push the pressing member 134 down, so that the ink passage 118 can communicate with the ink passage 116. In this state, the circulation pump 104 is operated. If then, the ink inside the ink cartridge 62 is suctioned by the circulation pump 104, and then is supplied to the sub tank 106 via the ink passage 116. In FIG. 8, the process in which the ink suctioned by the ink cartridge 62 is supplied to the sub tank 106 is represented by an arrow of a thick short-dashed line. In the ink circulation system according to the embodiment, the ink liquid surface inside the sub tank 106 is constantly maintained within a predetermined range by the liquid level sensor 106*s* provided in the sub tank 106.

In addition, the bubbles can be mixed into the ink supplied from the sub tank 106 to the ejecting head 102. Alternatively, in a case of carrying out an initial charge in which the ejecting head 102 is filled with the ink at an initial time, the bubbles are left in the passage extending to the ejecting head 102. The bubbles are carried by the ink, and then are captured soon by the head filter 102*f* which is provided in the ejecting head 102. Since the flow of the ink deteriorates at the portion in which the bubbles are captured by the head filter 102*f*, it is difficult to supply the ejecting nozzle with the ink. As a result, it is difficult to appropriately eject the ink. In addition, in the state where a lot of bubbles are adhered to the head filter 102*f* so as to deteriorate the flow of the ink, if the ink is ejected from the ejecting nozzle, a high negative pressure is exerted on the head filter 102*f*, so that the adhered bubbles can be drawn into the ejecting nozzle side (filter downstream chamber 102*d* side). If the bubbles are drawn into the filter downstream chamber 102*d*, the bubbles enter the portion of the ejecting nozzle, such that it is difficult to appropriately eject the ink. Accordingly, in order to avoid occurrence of such a circumstance, the ink circulation system according to the embodiment circulates the ink at the upstream side (filter upstream chamber 102*u*) of the head filter 102*f* inside the ejecting head 102 in this way.

Figure 9:
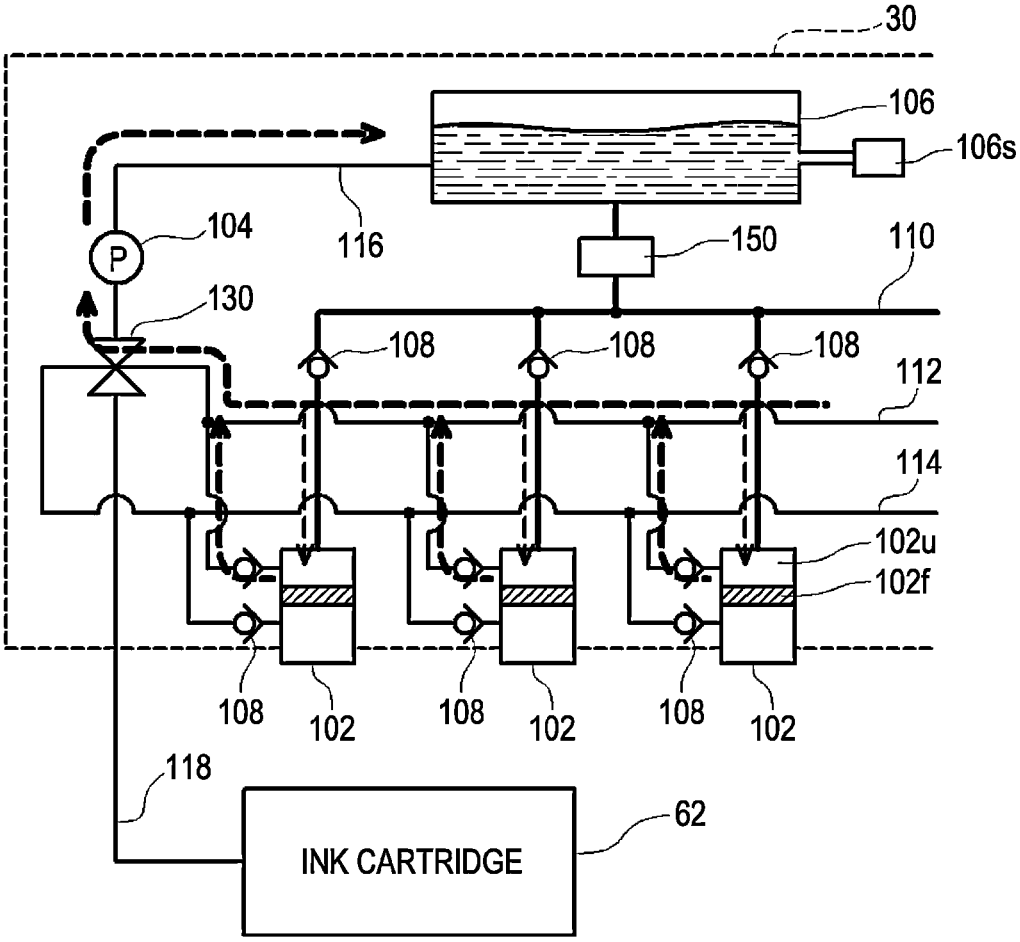
FIG. 9 is a diagram illustrating an aspect of circulating ink at an upstream side of a head filter.

FIG. 9 illustrates the operation of the ink circulation system according to the embodiment which circulates the ink in the filter upstream chamber 102*u*. First, the switching valve 130 communicates the upstream-side circulation passage 112 from the filter upstream chamber 102*u* with the ink passage 116 extended to the circulation pump 104. As described above with reference to FIG. 7, the cam ridge 142*a* placed at the position corresponding to the upstream circulation passage 112 does not push the pressing member 134 down, and the cam ridges 142*b* and 142*c* located at other positions push the pressing member 134 down, so that the upstream-side circulation passage 112 can communicate with the ink passage 116. In this state, by the operation of the circulation pump 104, the ink inside the filter upstream chamber 102*u* is suctioned by the circulation pump 104 through the check valve 108 and the upstream-side circulation passage 112, and then is supplied to the sub tank 106 via the ink passage 116. In FIG. 9, the process in which the ink suctioned by the filter upstream chamber 102*u* is supplied to the sub tank 106 is represented by an arrow of a thick short-dashed line.

In addition, if the ink is suctioned from the filter upstream chamber 102*u* in this way, the pressure at the downstream side of the pressure regulating valve 150 is lowered. Therefore, the pressure regulating valve 150 is opened, and thus receives the ink from the sub tank 106, so that the ink is supplied to the filter upstream chamber 102*u* through the ink supply passage 110 and the check valve 108. In FIG. 9, the process in which the ink is supplied to the filter upstream chamber 102*u* from the sub tank 106 is represented by an arrow of a short-dashed line. As a result, the ink is circulated between the sub tank 106 and the filter upstream chamber 102*u*.

The sub tank 106 has a passage cross section larger than the filter upstream chamber 102*u*, the ink passage (the ink supply passage 110, the upstream-side circulation passage 112, and the ink passage 116), the pressure regulating valve 150 or the like, and the flow of the ink is smooth. Therefore, the bubbles carried with the ink float in the sub tank 106, and thus the ink is separated from the bubbles. Accordingly, the ink separated from the bubbles is supplied to the filter upstream chamber 102*u* through the pressure regulating valve 150. In this way, since the ink is circulated between the sub tank 106 and the filter upstream chamber 102*u* while the bubbles are separated from the ink in the sub tank 106, it is possible to eliminate all of the bubbles mixed into the upstream side rather than the head filter 102*f* in the ejecting head 102. In addition, as the ink is just circulated between the sub tank 106 and the filter upstream chamber 102*u*, the ink is not discharged with the bubbles, such that the ink does not go to waste.

Of course, it is not possible to eliminate the bubbles mixed into the downstream side of the head filter 102*f* by only circulating the ink at the upstream side of the head filter 102*f*. If the bubbles mixed into the downstream side of the head filter 102*f* enter the portion of the ejecting nozzle, the ink is not appropriately ejected. Accordingly, since the ink circulation system according to the embodiment also circulates the ink in the filter downstream chamber 102*d*, it is possible to eliminate the bubbles mixed into the downstream side of the head filter 102*f*.

Figure 10:
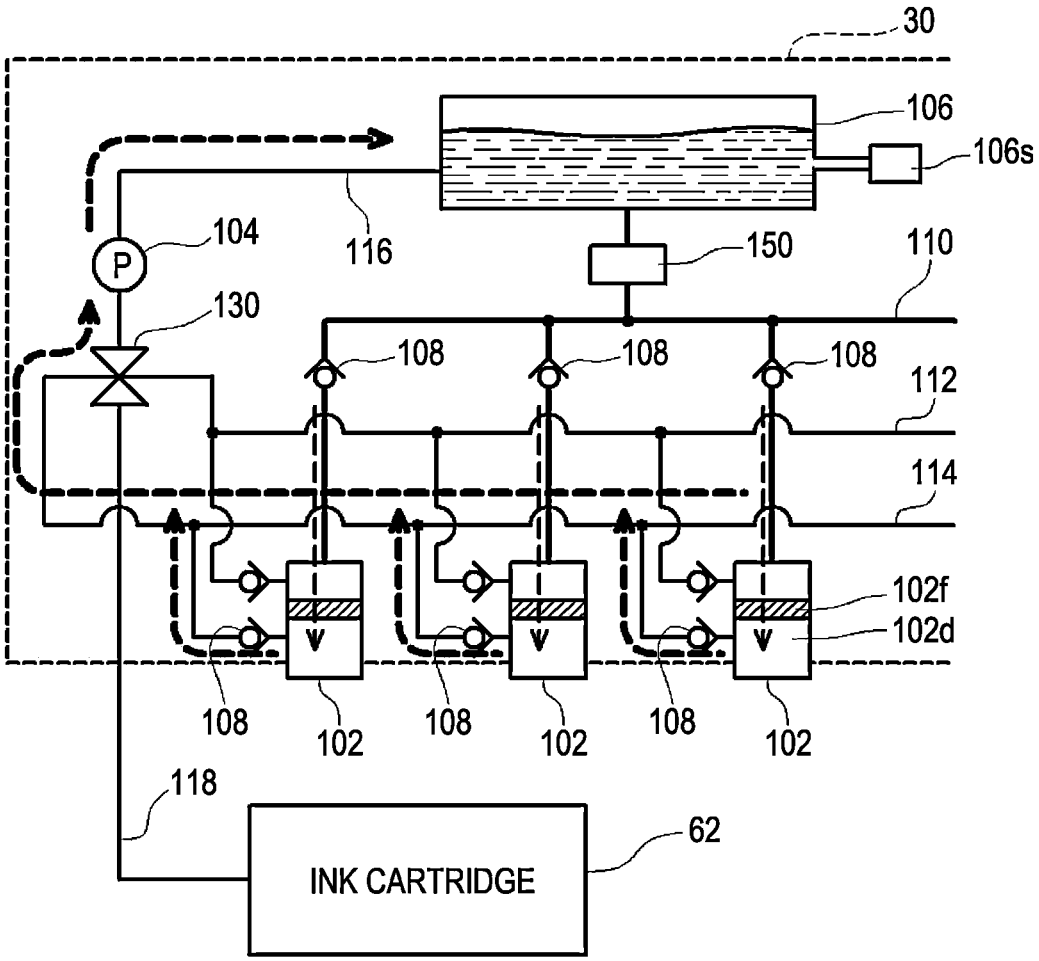
FIG. 10 is a diagram illustrating an aspect of circulating ink at a downstream side of a head filter.

FIG. 10 illustrates the operation of the ink circulation system according to the embodiment which circulates the ink in the filter downstream chamber 102*d*. In the case where the ink of the filter downstream chamber 102*d* is circulated, the switching valve 130 is switched in such a way that the downstream-side circulation passage 114 from the filter downstream chamber 102*d* communicates with the ink passage 116 extending to the circulation pump 104. As described with reference to FIG. 7, the cam ridge 142*b* placed at the position corresponding to the downstream-side circulation passage 114 does not push the pressing member 134 down, and the cam ridges 142*a* and 142*c* located at other positions push the pressing member 134 down, so that the downstream-side circulation passage 114 can communicate with the ink passage 116. In this state, by the operation of the circulation pump 104, the ink inside the filter downstream chamber 102*d* is suctioned by the circulation pump 104 through the check valve 108 and the downstream-side circulation passage 114, and then is supplied to the sub tank 106 via the ink passage 116. In FIG. 10, the process in which the ink suctioned by the filter downstream chamber 102*d* is returned to the sub tank 106 is represented by an arrow of a thick short-dashed line.

Similar to the case where the ink is suctioned from the filter upstream chamber 102*u*, in the case where the ink is suctioned from the filter downstream chamber 102*d*, the pressure at the downstream side of the pressure regulating valve 150 is decreased, and thus the pressure regulating valve 150 is opened. As a result, the ink is received from the sub tank 106, and then is supplied to the filter downstream chamber 102*d* through the ink supply passage 110 and the check valve 108. In FIG. 10, the process in which the ink is supplied from the sub tank 106 to the filter downstream chamber 102*d* is represented by an arrow of a short-dashed line. As a result, the ink is circulated between the sub tank 106 and the filter downstream chamber 102*d*.

In this way, as the ink is circulated between the sub tank 106 and the filter downstream chamber 102*d*, the bubbles are separated by the sub tank 106, so that it is possible to eliminate all of the bubbles mixed into the downstream side rather than the head filter 102*f* inside the ejecting head 102. Of course, since only the ink is circulated between the sub tank 106 and the filter downstream chamber 102*d*, the ink is not uselessly consumed in order to discharge the bubbles.

As described above, since the ink circulation system according to the embodiment switches the switching valve 130 to operate the circulation pump 104, the ink at the upstream side of the head filter 102*f* and the ink at the downstream side of the head filter 102*f* can be circulated among the sub tank 106 (refer to FIG. 9 and FIG. 10). As a result, in the case where the bubbles are mixed into the upstream side or downstream side of the head filter 102*f*, the bubbles are led to the sub tank 106 by the flow of the ink, so that only the bubbles can be captured in the sub tank 106. For this reason, as the line printer 1 according to the embodiment, in the case where the plurality of ejecting heads 102 are connected in parallel to each other, it is possible to completely discharge the bubbles inside each ejecting head 102. Of course, since only the ink inside the ejecting head 102 is circulated, the ink is not uselessly consumed in order to discharge the bubbles. In addition, the passage resistance generated when the ink is circulated is not completely equal among the respective ejecting heads 102, but there is no difference to the extent that the circulation quantity of the ink becomes increasingly different from each other. Accordingly, it is possible to reliably eliminate the mixed bubbles with respect to any ejecting head 102.

Further, in the case where the ink inside the sub tank 106 is reduced by ejecting the ink from the ejecting nozzles provided in the ejecting head 102, the switching valve 130 is switched to operate the switching pump 104, so that the sub tank 106 can be replenished with the ink inside the ink cartridge 62 (refer to FIG. 8). In addition, since each of the ejecting heads 102 is supplied with the ink from the sub tank 106 through the pressure regulating valve 150, it is possible to constantly maintain the supply pressure of the ink to the respective ejecting heads 102.

Since the switching of the upstream-side circulation passage 112, the downstream-side circulation passage 114, and the ink passage 118 is carried out by using the switching valve 130, the circulation of the ink inside the ejecting head 102 and the replenishment of the ink from the ink cartridge 62 can be carried out by using one circulation pump 104. Therefore, the number of components is decreased thereby causing the possibility of breakdown or assembling mistake at the time of manufacturing to reduce, and suppressing the increase in manufacturing cost.

Further, since each of the ejecting heads 102 is supplied with the ink through one pressure regulating valve 150, it is not necessary to install the pressure regulating valve 150 for every ejecting head 102. For this reason, due to variations in the operation pressure of the pressure regulating valve 150, it is possible to suppress variations in the supply pressure of the ink between the ejecting heads 102. Furthermore, since each ejecting head 102 uses the pressure regulating valve 150 in common, the number of components is decreased thereby causing the possibility of breakdown or assembling mistakes at the time of manufacturing to reduce, and suppressing the increase in manufacturing cost.

Furthermore, the check valves 108 are respectively provided in the ink supply passage 110 for supplying the ink to the ejecting head 102, the upstream-side circulation passage 112 for circulating the ink from the filter upstream chamber 102*u* of the ejecting head 102, and the downstream-side circulation passage 114 for circulating the ink from the filter downstream chamber 102*d*. For this reason, in the case where the suction cleaning which suctions the ink inside the ejecting head 102 is performed, for example, by exerting the negative pressure on the ejecting nozzles of the ejecting head 102, there is no case where the ink flows back from the adjacent ejecting head 102 thereby suctioning the bubbles with the ink.

In addition, the ink circulation system according to the embodiment is provided with two-systematic circulation passage, that is, the circulation passage for circulating the ink (that is, ink inside the filter upstream chamber 102*u*) of the upstream side rather than the head filter 102*f* of the ejecting head 102, and the circulation passage for circulating the ink (that is, the ink inside the filter downstream chamber 102*d*) of the downstream side rather than the head filter 102*f*. The ink can only be circulated in any one of the circulation passages by switching the switching valve 130. As the ink is circulated in any one circulation passage, even though the capacity of the circulation pump 104 is not increased arbitrarily, the flow velocity of the ink in the ejecting head 102 or the circulation passage on the way of the ejecting head is maintained at a sufficient value, so that the bubbles can be further completely discharged. Of course, if the ink is simultaneously circulated in two circulation passages by switching the switching valve 130, the flow velocity of the ink is decreased, but the bubbles inside the ejecting head 102 can be discharged at once.

D. Modified Example

The above-described embodiment has described the configuration in which the filter for eliminating the foreign substances mixed into the ink (that is, the head filter 102*f*) is installed in the ejecting head 102. However, the filter for eliminating the foreign substances contained in the ink may be installed at the upstream side (that is, between the sub tank 106 and the pressure regulating valve 150) of the pressure regulating valve 150. This causes the circulation passage of the ink to become simplified. As a result, it is possible to constitute the ink circulation system with the further simple configuration. Next, the ink circulation system according to the modified example will be described. In this instance, by designating the same reference numerals as the embodiment for the same constitutional portions of the modified example as those of the above-described embodiment a detailed description can be omitted.

Figure 11:
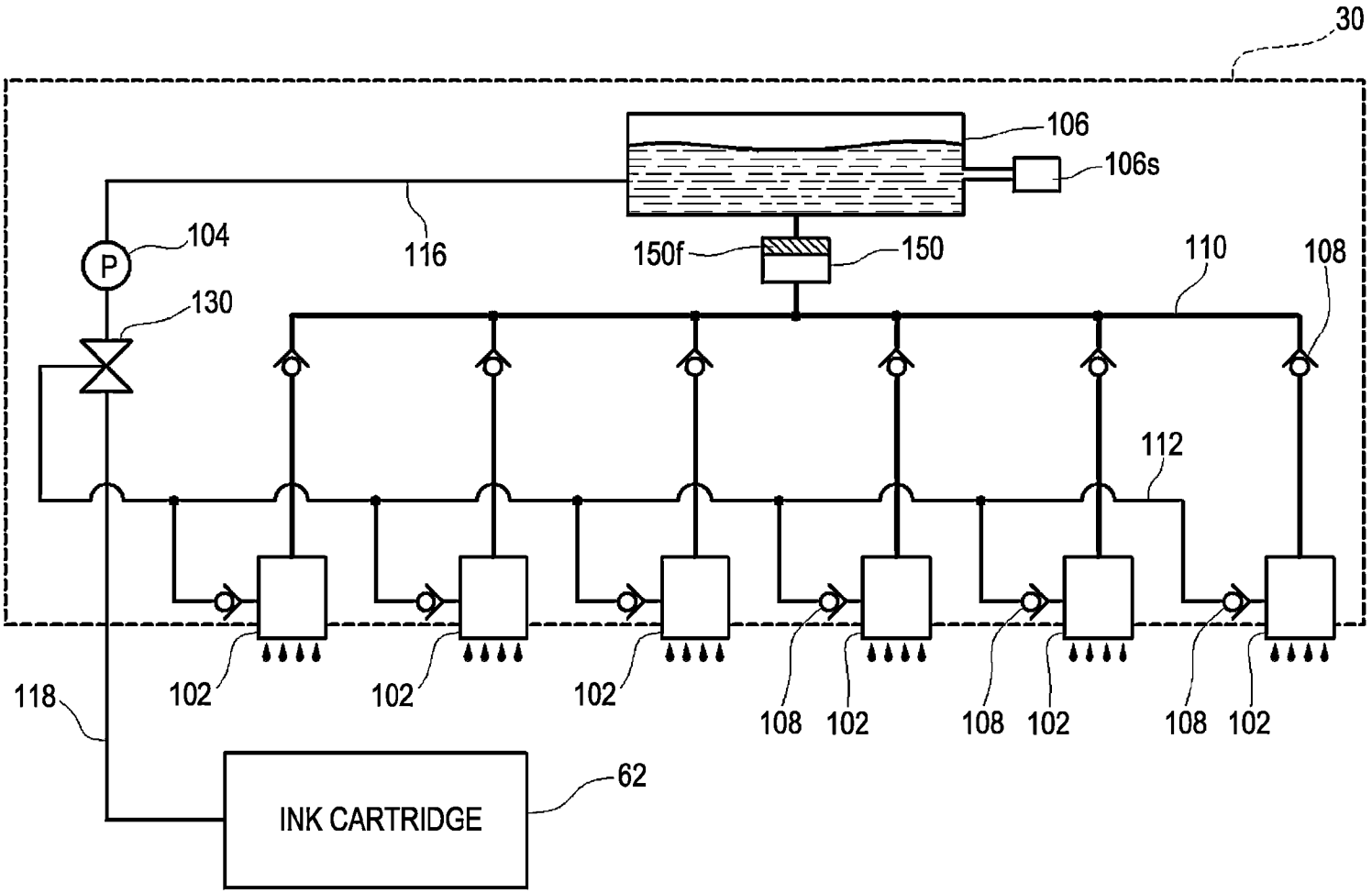
FIG. 11 is a diagram illustrating the configuration in which circulated ink is supplied to an ejecting head in a line printer according to a modified example.

FIG. 11 is a diagram illustrating the configuration of the ink circulation system according to the modified example. In this instance, as described above with reference to FIG. 1 and FIG. 2, the line printer 1 according to the modified example is provided with an ejection unit 100 for every ink, that is, C (cyan) ink, M (magenta) ink, Y (yellow) ink, and K (black) ink. Each of the ejection units 100 is provided with the same ink circulation system. Accordingly, only one ejection unit 100 is illustrated as a representative in FIG. 11.

As shown in FIG. 11, the ink circulation system according to the modified example includes a tank filter 150*f* for eliminating foreign substances contained in the ink which is provided between the sub tank 106 and the pressure regulating valve 150. In addition, since the foreign substances contained in the ink are eliminated by the tank filter 150*f*, the head filter 102*f* is not provided in the ejecting head 102. For this reason, since the interior of the ejecting head 102 is not partitioned into two parts by the head filter 102*f* in the modified example, it is not necessary to install two circulation passages. That is, the ink circulation system according to the modified example includes a configuration in which the upstream-side circulation passage 112 and the downstream-side circulation passage 114 in the ink circulation system according to the embodiment shown in FIG. 3 are combined to form one circulation passage 112.

In addition, since the tank filter 150*f* is provided between the sub tank 106 and the pressure regulating valve 150, the ink supply passage 110 between the tank filter 150*f* and the sub tank 106 is shortened. Accordingly, for example, even though the bubbles are adhered to the surface of the tank filter 150*f* at the upstream side, if left untreated for a moment, the ink is relatively easily moved to the sub tank 106 due to the buoyant force of the bubbles. For this reason, in the ink circulation system according to the modified example, it is not necessary to forcedly circulate the ink at the upstream side of the tank filter 150*f*. In particular, if the tank filter 150*f* is provided at the position in which the upstream-side surface of the tank filter 150*f* directly faces the sub tank 106, it is not necessary to circulate the ink at the upstream side of the tank filter 150*f* completely.

In the ink circulation system according to the modified example, since the circulation passage of the ink is simple, it is possible to further suppress the passage resistance generated when the ink is circulated. As a result, since the number of components is decreased thereby causing the possibility of breakdown or assembling mistakes at the time of manufacturing to reduce, and suppressing the increase in manufacturing cost. In addition, in the ink circulation system according to the modified example, since each of the ejecting heads 102 is supplied with the ink through the pressure regulating valve 150, it is possible to maintain the pressure of the ink supplied to the ejecting head 102 within an appropriate pressure range. As a result, the ink can be appropriately ejected from each of the ejecting heads 102.

In addition, in the ink circulation system according to the modified example, the foreign substances contained in the ink can be eliminated by the tank filter 150*f* which is provided at the upstream side of the pressure regulating valve 150. For this reason, the foreign substances contained in the ink do not cause the malfunction in the operation state of the pressure regulating valve 150. As a result, it is possible to constantly maintain the pressure of the ink supplied to each of the ejecting heads 102 within the stable pressure range.

Although the embodiments of the invention are described hereinbefore, it should be noted that the invention is not limited to the above-described embodiments, and proper modifications can be undergone within the scope without deviating from the aspects of the invention.

For example, the configuration, in which the switching valve 130 is driven by a cam, is described in the above-described embodiment. However, it is not limited to a cam, and the switching valve 130 may be driven by, for example, an electronic method using a solenoid, or the switching valve 130 may be driven by using pneumatic pressure.

What is claimed is:

1. A liquid ejecting apparatus comprising: an ejecting head ejecting a liquid from ejecting nozzles, the ejecting head including a head chamber that stores the liquid;

a liquid supply unit for mounting a liquid container that stores the liquid; a liquid supply passage communicating with the head chamber, the liquid supply passage supplying the liquid ejected from ejecting nozzles;

a liquid passage communicating with the liquid container mounted to the liquid supply unit and connecting to the liquid supply passage for supplying the liquid stored in the liquid container toward the ejecting head via the liquid supply passage;

a chamber part provided in the liquid supply passage, the chamber part having a wall formed with a thin film that transforms corresponding to a pressure fluctuation of the chamber part;

a connecting passage communicating with the head chamber and connected to a connection portion away from the head chamber rather than the chamber part in the liquid supply passage, the connecting passage forming a circulation passage in cooperation with the liquid supply passage and the head chamber; and a circulation pump provided in the circulation passage configured to circulate the liquid in the circulation passage when driven, the circulation pump sucking the liquid inside the head chamber without going through the chamber part, wherein the liquid is circulated to flow in a direction toward the head chamber from the chamber part in the liquid supply passage and to flow in a direction toward the connection portion from the head chamber in the connecting passage, wherein the liquid ejected onto a medium from ejecting nozzles is supplied to the head chamber from the liquid supply passage with liquid flow toward the head chamber in the connecting passage being restricted via a check valve;

wherein the liquid ejecting apparatus is configured such that liquid supply and liquid circulation is performed by use of a common pump, the common pump being the circulation pump.

2. The liquid ejecting apparatus according to claim 1, further comprising:

a cap configured to contact with the ejecting head for sucking the liquid inside the ejecting head, wherein the liquid inside the ejecting head is sucked with liquid flow toward the head chamber in the connecting passage being restricted via the check valve.

3. The liquid ejecting apparatus according to claim 1, further comprising:

a switching valve provided where the liquid supply passage, the liquid passage and the connecting passage join together, the switching valve being configured to switch an aspect of flowing the liquid between the liquid supply passage, the liquid passage and the connecting passage.

4. The liquid ejecting apparatus according to claim 1, further comprising:

a filter provided between the chamber part and the connection portion in the liquid supply passage.

5. The liquid ejecting apparatus according to claim 1, wherein the liquid is ejected on the medium supported by a support member with the ejecting head fixed above the support member.

6. A liquid ejecting apparatus comprising:

an ejecting head ejecting a liquid from ejecting nozzles, the ejecting head including a head chamber that stores the liquid;

a liquid supply unit for mounting a liquid container that stores the liquid;

a liquid passage communicating with the liquid container mounted to the liquid supply unit for supplying the liquid stored in the liquid container toward the ejecting head;

a liquid supply passage provided between the liquid passage and the head chamber;

a connecting passage provided between the liquid passage and the head chamber, the connecting passage being separate from the liquid supply passage and forming a circulation passage in cooperation with the liquid supply passage and the head chamber;

a chamber part provided in the liquid supply passage, the chamber part having a wall formed with a thin film that transforms corresponding to a pressure fluctuation inside the chamber part; and a check valve provided between the chamber part and the head chamber in the liquid supply passage, the check valve preventing liquid flow in a direction toward the chamber part from the ejecting head in the liquid supply passage, wherein the liquid is circulated to flow in a direction toward the head chamber in the liquid supply passage and to flow in a direction away from the head chamber in the connecting passage, wherein the liquid ejected onto a medium from ejecting nozzles is supplied to the head chamber from the liquid supply passage with liquid flow toward the head chamber in the connecting passage being restricted.

7. The liquid ejecting apparatus according to claim 6, further comprising:

a filter provided upstream from the chamber part in the liquid supply passage.

8. The liquid ejecting apparatus according to claim 7, wherein the chamber part includes the filter.

9. The liquid ejecting apparatus according to claim 6, further comprising:

a switching valve provided in the liquid passage to be possible to switch an aspect of flowing the liquid.

10. The liquid ejecting apparatus according to claim 6, further comprising:

a cap configured to contact with the ejecting head for sucking the liquid inside the ejecting head, wherein the liquid inside the ejecting head is sucked with liquid flow toward the head chamber in the connecting passage being restricted.

11. The liquid ejecting apparatus according to claim 1, further comprising:

a second check valve that is provided in the connecting passage and is configured to prevent liquid flow in a direction toward the head chamber in the connecting passage.

12. The liquid ejecting apparatus according to claim 6, wherein outside of the wall formed with the thin film communicates with atmosphere.

* * * * *